United States Patent [19]

Wirt

[11] Patent Number: 4,600,078

[45] Date of Patent: Jul. 15, 1986

[54] SOUND BARRIER

[75] Inventor: Leslie S. Wirt, Newhall, Calif.

[73] Assignee: Lockheed Corporation, Burbank, Calif.

[21] Appl. No.: 560,632

[22] Filed: Dec. 12, 1983

[51] Int. Cl.[4] ..... E04B 1/82

[52] U.S. Cl. ..... 181/286; 181/290; 181/295; 181/289

[58] Field of Search ..... 181/284, 285, 286, 288, 181/289, 295, 210, 292, 293, 250, 290

[56] References Cited

U.S. PATENT DOCUMENTS

| | | | |
|---|---|---|---|
| 2,297,046 | 9/1942 | Bourne | 181/250 |
| 3,875,706 | 4/1975 | Okawa | 181/289 X |
| 4,319,661 | 3/1982 | Proudfoot | 181/286 X |

*Primary Examiner*—L. T. Hix
*Assistant Examiner*—Brian W. Brown
*Attorney, Agent, or Firm*—Frederic P. Smith

[57] ABSTRACT

A sound barrier (22) comprising a pair of spaced apart members (24,26), a medium (34) disposed between the members capable of propagating sound waves, and one or more acoustical resonators (30) coupled to the medium and tuned to one or more selected frequencies. The resonators may be disposed between the members or may be disposed around the outer periphery of the members to permit construction of a sound barrier window. The resonators may form an integral part of one of the members or may be suspended between the members by netting or sound insulating material.

27 Claims, 14 Drawing Figures

FIG. 1
PRIOR ART
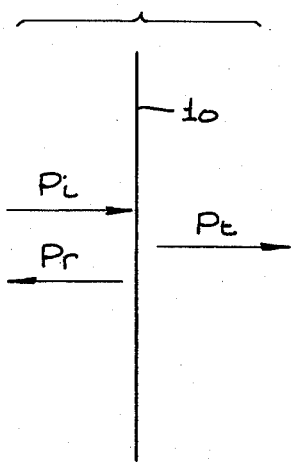
FIG. 2
PRIOR ART
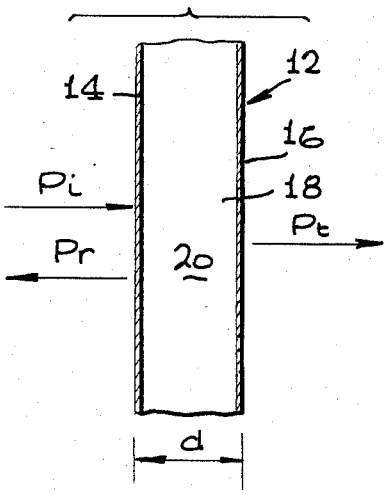
FIG. 3
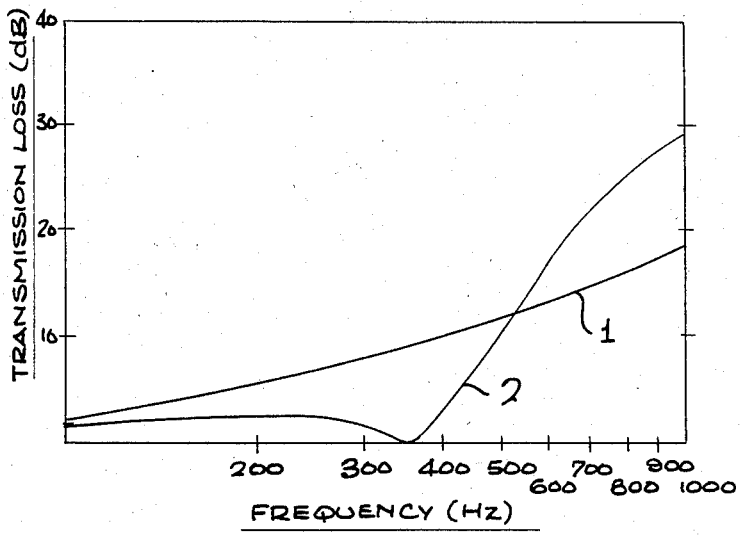
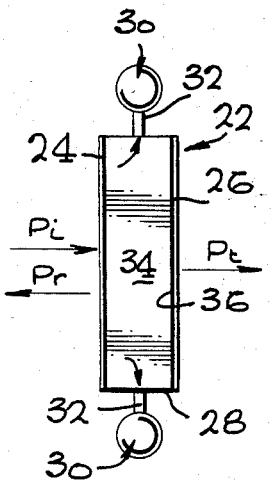
FIG. 4

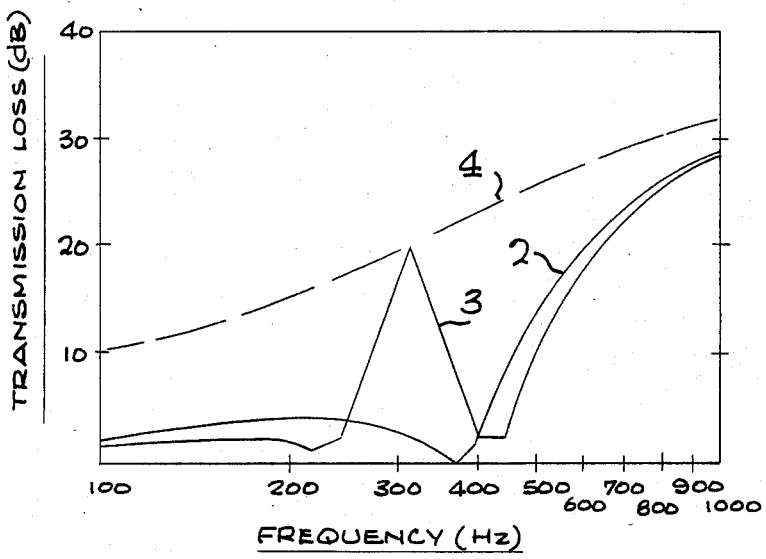
FIG. 5
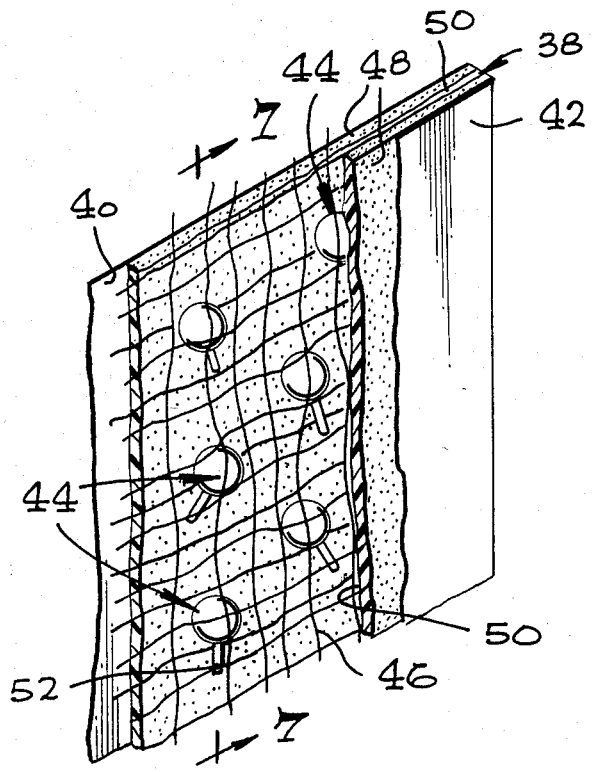
FIG. 6
FIG. 7
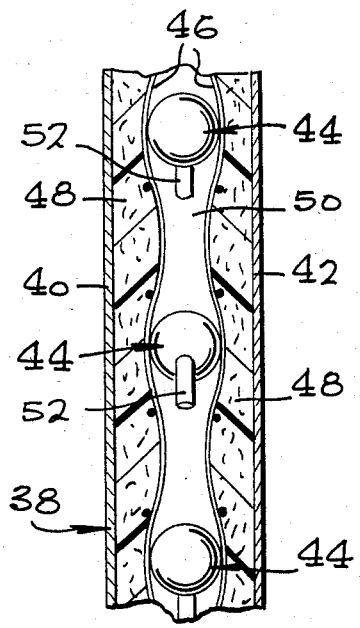

FIG. 8
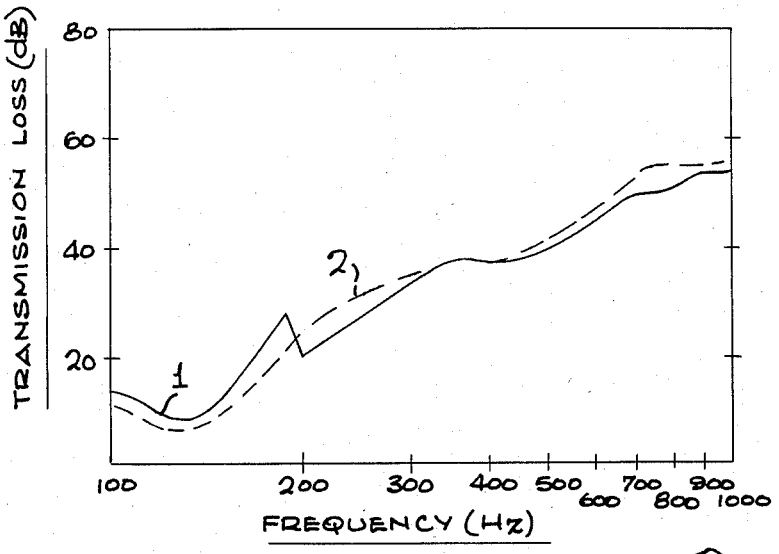
FIG. 9
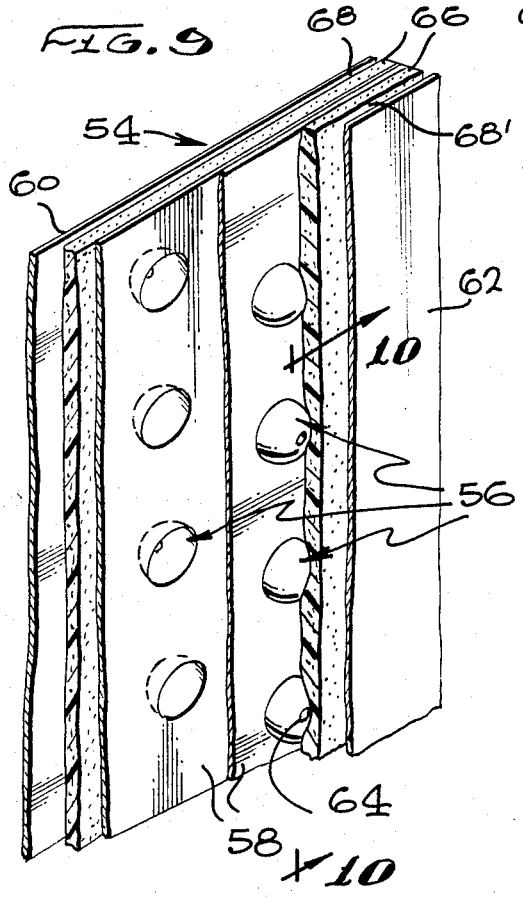
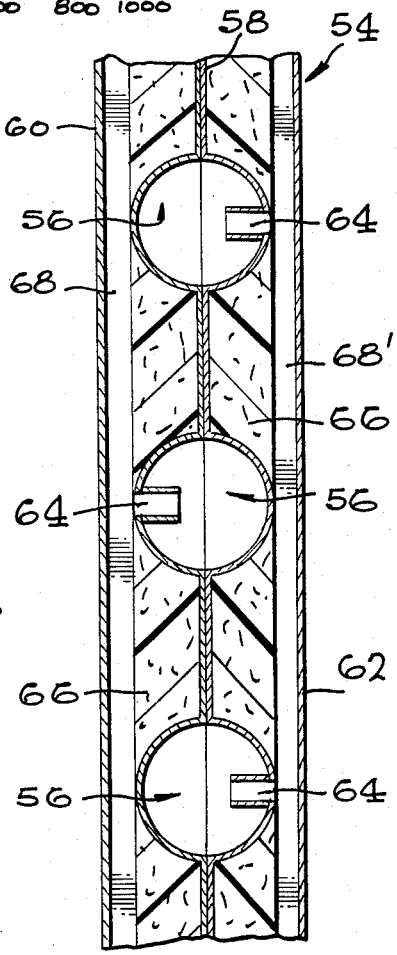
FIG. 10

FIG. 11
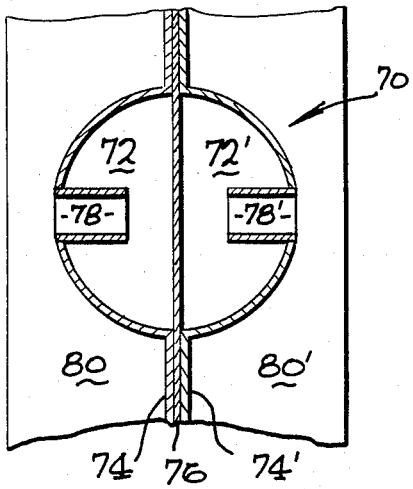
FIG. 13
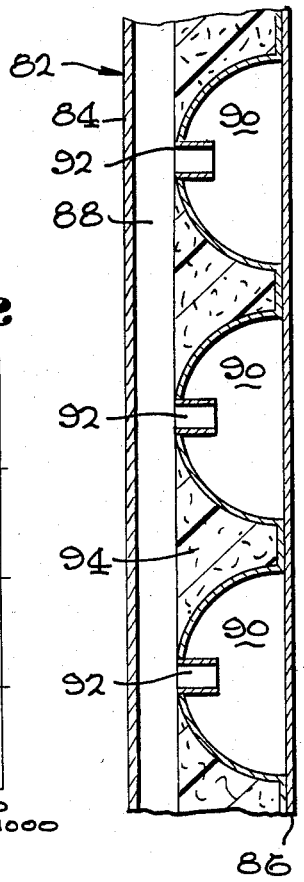
FIG. 12
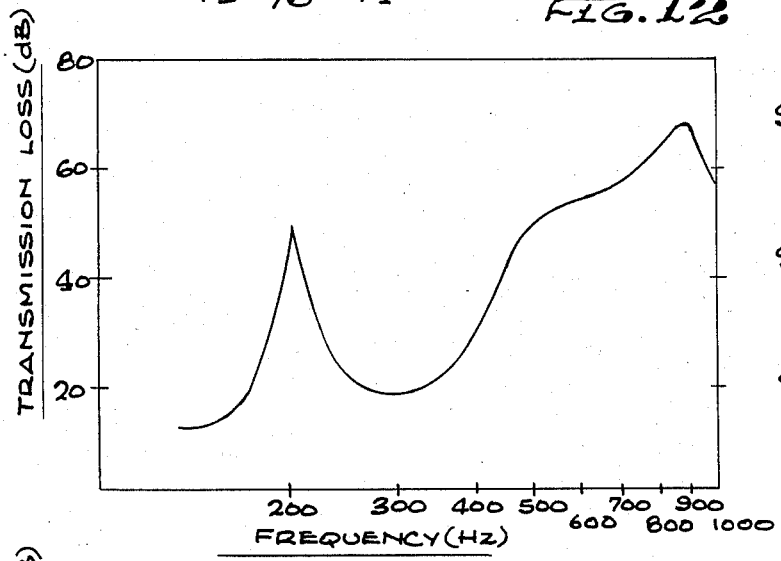
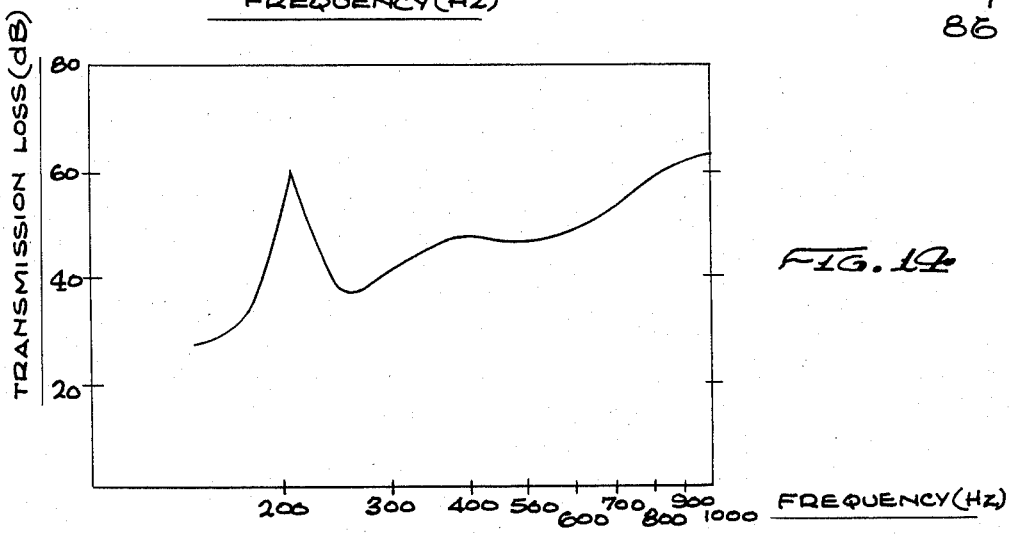
FIG. 14

SOUND BARRIER

TECHNICAL FIELD

The invention relates to the field of sound barriers and in particular to a sound barrier capable of providing augmented transmission loss at selected frequencies.

BACKGROUND ART

It is well known in the field of sound barrier walls that the effectiveness of a single wall is proportional to its surface density (weight per unit area) and that the effectiveness of a single wall increases in proportion to the frequency of the sound. Thus, in order to exclude low frequency sound very massive walls are required.

Since, however, some sound barrier applications cannot tolerate great weight, such as the sidewalls of passenger transport aircraft which must exclude intense exterior sound but at the same time must be as light as possible, the need for lighter weight walls led to the development of compound wall structures. It was found that in the range of medium to high frequencies a compound wall, comprising a relatively light outer wall, such as a fuselage skin, and a light inner wall, such as a trim panel, spaced apart with an intervening airspace, could provide considerably greater sound reduction for a given total weight. Further improvement in reduction could be obtained if sound absorptive material such as a fiberglass blanket was placed in the airspace between the inner and outer walls. These blankets also served to provide essential thermal insulation and are known as thermoacoustical blankets. Small additional benefits were sometimes obtainable by subdivision of the thermoacoustical blanket into several layers by means of thin flexible sheets (septa). These compound walls were intensively developed and attained a high degree of refinement, and are used universally on transport aircraft powered by jet or turbofan engines.

The compound walls which serve to exclude the middle and high frequency sound from transport aircraft cabins are, however, actually inferior to a single wall of the same weight at lower frequencies. Moreover, single walls designed to exclude, for example, the intense blade passage frequencies produced by high performance propeller driven aircraft would be prohibitively heavy and the required weight would negate much if not all of the potential fuel savings attainable with this type of propulsion.

Accordingly, it is a general object of the present invention to provide an improved sound barrier.

It is another object of the present invention to provide a lightweight sound barrier with increased transmission loss effectivity.

It is a further object of the present invention to provide a sound barrier which produces augmented sound reduction at selected frequencies.

It is still another object of the present invention to provide a sound barrier which incorporates resonant acoustical elements.

It is a further object of the present invention to provide a sound barrier suitable for the construction of fuselage walls for propeller driven aircraft.

DISCLOSURE OF INVENTION

A sound barrier is provided comprising a pair of spaced apart members, a medium disposed between the members capable of propagating sound waves, and one or more acoustical resonators coupled to the medium and tuned to one or more selected frequencies. The resonators may be disposed between the members or may be disposed around the outer periphery of the members to permit construction of a sound barrier window. The resonators may form an integral part of one of the members or may be suspended between the members by netting or sound insulation material.

The novel features which are believed to be characteristic of the invention, both as to its organization and its method of operation, together with further objects and advantages thereof, will be better understood from the following description in connection with the accompanying drawings in which a presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 1 is a schematic cross-sectional view of a part of a single sound barrier wall used in the prior art.

FIG. 2 is a schematic cross-sectional view of a part of a simple sound barrier compound wall used in the prior art.

FIG. 3 graphically illustrates transmission loss versus frequency for the single wall and the simple compound wall of FIGS. 1 and 2.

FIG. 4 is a schematic cross-sectional view of a first embodiment of the invention.

FIG. 5 graphically illustrates transmission loss versus frequency for the simple compound wall of FIG. 2 and the first embodiment of the invention shown in FIG. 4.

FIG. 6 is an isometric view, partly broken away, of a second embodiment of the invention.

FIG. 7 is a cross-sectional view of the second embodiment of the invention taken along the lines 7—7 of FIG. 6.

FIG. 8 graphically illustrates transmission loss versus frequency for the embodiment of FIG. 6.

FIG. 9 is an isometric view, partly broken away, of a third embodiment of the invention.

FIG. 10 is a cross-section view of the third embodiment of the invention taken along the lines 10—10 of FIG. 9.

FIG. 11 is a cross-sectional view of a modified form of a resonator useful in the third embodiment of the invention.

FIG. 12 graphically illustrates transmission loss versus frequency for the embodiment of FIG. 9.

FIG. 13 is a cross-sectional view of a fourth embodiment of the invention.

FIG. 14 graphically illustrates transmission loss versus frequency for the embodiment of FIG. 13.

BEST MODE FOR CARRYING OUT THE INVENTION

To obtain insight into the significance of the present invention it is useful to compare in a semiquantitative manner sound barriers composed of a single wall, a compound wall, and an embodiment of the present invention. Referring now to FIG. 1, a sound wave $p_i$ of oscillating sound pressure impinges on a wall 10 having a surface mass M per unit area. As is well known, the greater the mass M, the greater the interia of the wall 10 and hence the less the wall 10 moves in vibratory motion to reradiate sound as sound wave $p_t$. A portion of the sound wave $p_i$ is reflected as sound wave $p_r$. Increasing the frequency F of the sound has the same effect as increasing the surface mass M. Thus, the effectiveness of a simple single wall sound barrier is proportional to the product $M \times F$. It is clear that the mass M must become large if the frequency F is small to attain any particular value of sound reduction. Curve 1 of FIG. 3 illustrates the transmission loss TL expressed in decibels as a function of frequency in Hz for a simple single wall weighing 0.2 pounds per square foot.

The transmission loss TL of a nonrigid single wall of surface density M is given in decibels by the relation $$TL = 10 \log_{10}\left(1 + \frac{w^2M^2}{(2\rho c)^2}\right)$$

where $w = 2\pi F$

F = frequency $\rho$ = density of air c = velocity of sound

This is known as the ideal mass law. The derivation of the ideal mass law may be found on page 144 of "Sound Insulation", by P. V. Bruel, published by Chapman and Hall, London, 1951. For large values of w or M, the numeral 1 in the above equation can be neglected and thus each doubling of either F or M results in about 6 dB of additional transmission loss.

FIG. 2 shows a simple sound barrier compound wall 12 comprising an outer wall 14 of surface density $M_1$, an inner wall 16 of surface density $M_2$ and an intervening space 18 of width d having a sound supporting medium 20, such as air, therein. The merit of this double wall 12 is that at sufficiently high frequencies the transmission loss due to $M_1$ and that due to $M_2$ become additive. Thus, it is readily possible to obtain quite large values of transmission loss at medium and high frequencies without excessive weight. Curve 2 of FIG. 3 illustrates the transmission loss in decibels versus frequency for the case $M_1 = M_2 = 0.1$ lb. per ft.$^2$ and d = 4 inches.

A comparison of curves 1 and 2 of FIG. 3 shows that above 500 Hz the transmission loss of the double wall 12 (curve 2) exceeds that of the single wall 10 (curve 1). However, at all frequencies below 500 Hz the transmission loss of the single wall 10 is small but greater than that of the double wall 12. In fact, in theory the transmission loss of the double wall 12 becomes zero at a frequency $F_o$ given approximately by $$F_o = \frac{170}{\sqrt{\frac{M_1M_2}{M_1 + M_2} \cdot d}}$$

which for $M_1 = M_2 = 0.1$ lb. per ft.$^2$ and d = 4 inches is about 350 Hz. The above equation may be found on page 25 of "Sound and Vibration," August 1970 in an article by B. Fader entitled "Mass-Air-Mass Resonance."

The fallout in the transmission loss at $F_o$ is due to an unavoidable system resonance. In theory, mass $M_1$ and mass $M_2$ (walls 14 and 16) are connected by an air spring provided by the air 20 entrapped between them. Masses $M_1$ and $M_2$ first approach each other, compressing the air spring, then retreat from each other. Their common center of gravity remains stationary. The nature of this motion is often called pattycake and $F_o$ is known as the pattycake frequency. The influence of this resonance is sufficient to reduce the double wall transmission loss to below that of the single wall at all frequencies below 500 Hz where curves 1 and 2 cross in FIG. 3. The lowest possible pattycake frequency is obtained when $M_1 = M_2$. In practice, the space 18 is often partly or completely filled with thermal insulation such as fiberglass. This contributes enough acoustical damping of the resonance to mitigate the fallout of the double wall transmission loss but the basic trends shown by curves 1 and 2 of FIG. 3 remain the same.

In FIG. 4 a first embodiment of the present invention is illustrated. The sound barrier 22 consists of an outer wall 24 and an inner wall 26 spaced apart by frame 28. The frame 28 has acoustical resonators 30 connected thereto with their throats 32 coupled to the air 34 in the space 36 between outer wall 24 and inner wall 26. The volume V, the throat area A and the effective length of the throat l of the resonators 30 may be adjusted to produce a resonance in the resonsators 30 at, for example, $F_o$, the pattycake frequency. The resonant frequency of the acoustical resonators 30 would be in accordance with the relation found on pages 108–114 of "Sound Insulation," by P. V. Bruel, cited above.

$$F = \frac{C}{2\pi}\sqrt{\frac{A}{Vl}}$$

In operation, as the outer wall 24 and inner wall 26 move towards each other they tend to compress the air 34 and thereby sustain the pattycake motion. The resonators 30, however, are tuned to the same frequency $F_o$. The resonant air inflow into the resonators, indicated by the arrows, prevent, however, the buildup of pressure of the air 34 in the space 36, thus depriving the pattycake resonance of its restoring force and preventing the coupling of the outer and inner walls. Using an electrical analogy, the resonator provides a shunting path for the energy which would otherwise have proceeded from outer wall 24 to inner wall 26. FIG. 5 presents a comparison of the transmission loss of the double wall of FIG. 2 (curve 2) and the double wall of FIG. 4 (curve 3) with the resonators 30 tuned to 315 Hz, near $F_o$. Thus the patty-cake dropout of the double wall of FIG. 2 (curve 2) has been converted to a strong peak of transmission loss at F = 315 Hz by use of the resonators 30 of the present invention. Curve 4 is the envelope of the peaks of transmission loss obtainable by varying the resonant frequency of the resonators 30. As is illustrated, the efficacy of the resonators 30 in increasing transmission loss decreases at higher frequencies. The embodiment shown in FIG. 4 can be used for constructing double glazed windows such as are used on aircraft. Both the outer and inner walls 24, 26 would be made from a transparent plastic while the resonators 30 would be concealed in the frame 28 for such a window.

FIGS. 6 and 7 illustrate a second embodiment of the present invention. The sound barrier 38 includes an outer wall 40 and an inner wall 42 between which are located resonators 44. Resonsators 44 may, for example, be supported by netting 46. Fiberglass blankets 48 may also be placed between outer wall 40 and the resonators 44 and between the inner wall 42 and the resonators 44. The netting 46 constrains the fiberglass blankets 48 to assure an empty space 50 at the center of the sound barrier 38 to which the throats 52 of the resonators 44 are coupled.

The operation of this embodiment is substantially the same as already described for the embodiment of FIG. 4. The presence of the fiberglass blankets 48 contributes supplemental damping which both suppresses unwanted numerous minor resonances and also improves the high frequency transmission loss. The fiberglass blankets 48 also provide desirable thermal insulation. FIG. 8 illustrates in curve 1 the measured transmission loss for a 44 inch×44 inch wall comprising inner and outer panels of 0.040 inch thick alumium spaced 4 inches apart. The airspace between the panels contains 16 spherical resonators tuned to 190 Hz and supported between two layers of netting. The space between the netting and each panel is filled with 0.6 lb./ft.$^3$ AA type fiberglass blanket. The spherical resonators are 3.5 inches in diameter and occupy about 5% of the airspace. Curve 2 in FIG. 8 shows the measured transmission loss for the same structure with the resonators removed and with the entire airspace filled with fiberglass. As is apparent, there is a significant difference between curves 1 and 2 due to the appearance of a transmission loss peak at 190 Hz caused by the inclusion of the resonators. The height of this peak would increase as more resonators are added. In this embodiment the resonators contribute significantly to the transmission loss only at or near their resonant frequency.

A third embodiment of the present invention is shown in FIGS. 9 and 10. In this embodiment the mass of the resonators is utilized to contribute to the transmission loss at all nonresonant frequencies in much the same manner as a single wall. As indicated in FIGS. 9 and 10, the sound barrier 54 includes resonators 56 which are connected by an impermeable sheet 58 located between the outer wall 60 and the inner wall 62 near the center of the sound barrier 54. Such a layer of resonators 56 may be conveniently fabricated by forming matching hemispherical cavities in two sheets of metal or plastic and then coupling the flat surfaces together. The resonator throats 64 may then be bonded or welded into place. The length and diameter of the resonator throats 64 are adjusted to obtain the desired tuning of the resonators 56. The space between the resonators 56 may be filled flush with fiberglass 66. Outer wall 60 and inner wall 62 are spaced away from the fiberglass 66 by airspaces 68 and 68' to assure an empty space to which the resonator throats 64 can be coupled.

In operation, at the tuned frequency of the resonators 56, the resonators 56 decouple the outer and inner walls 60, 62 from the impermeable sheet 58 by ingesting airflow to spoil the air springs of airspaces 68 and 68', as previously described for the first embodiment. At all nonresonant frequencies, the transmission of vibrating motion through the wall is impeded by the inertia of the impermeable sheet 58, including the resonators 56, essentially as described for the single wall.

Several variations of this third embodiment may be used to adapt it to particular design problems. For example, while FIG. 9 shows alternate resonators coupled to alternate airspaces, it is possible to couple all the resonators to one airspace and fill the other airspace with additional fiberglass. This might be done to obtain increased thermal insulation. FIG. 11 shows a modified form of resonator 70 suitbale for the sound barrier of FIG. 9. The resonator 70 is formed from two hemispherical cavities 72, 72' in impermeable sheets 74, 74' bonded to a central impermeable sheet 76. Throats 78, 78' are connected to the cavities 72, 72' and to the airspaces 80, 80'. FIG. 12 presents the transmission loss for a compound wall of the type shown in FIG. 9. Near 200 Hz there is a substantial increase in the transmission loss due to the action of the resonators. At higher frequencies, the transmission loss again rises in the manner characteristic of a compound wall of appreciable mass due to the presence of the impermeable sheet including the resonators.

FIG. 13 ilustrates a fourth embodiment of the invention. Sound barrier 82 includes outer wall 84 and inner second wall 68 separated by airspace 88. The resonators 90 are hemispherical in shape and are shown attached to inner wall 86, but may be attached to outer wall 84 if desired. The resonator throats 92 couple into the airspace 88 as before. The space between resonators 90 may be filled with thermoacoustical fiberglass 94 with the approaches to the resonator throats left unobstructed. In a typical design, the walls 84 and 86 would each weigh 2 pounds per square foot and be separated by a 3-inch airspace. The hemispherical resonators 90 would have a diameter of 5 inches. This design would be appropriate for the sidewall of a propeller driven aircraft in the area of the plane of rotation of a propeller having a blade passage frequency near 200 Hz. If the surface masses, the airspace, and the diameter of the hemispheres are doubled, the design could be used for an enclosure for a transformer having a magnetostrictively generated sound frequency of 120 Hz. In both of these applications, the resonator throat area A and length l would be adjusted to provide the appropriate resonant frequency. The shape of the sound barrier wall would vary for the appropriate usage, such as the curved wall used for fuselage construction, and would not be limited to the flat panel walls illustrated in the figures.

FIG. 14 presents transmission loss versus frequency for a panel of the type shown in FIG. 13. Outer wall 84 weighs 0.93 pounds per square foot and inner wall 86 weighs 3 pounds per square foot including the resonators 90. The airspace 88 separating walls 84 and 86 is 2.8 inches. The space between resonators 90 is filled with B type fiberglass having a density of about one pound per cubic foot.

Having described the invention, it is obvious that numerous modifications and departures may be made by those skilled in the art. Thus, the invention is to be construed as being limited only by the spirit and scope of the appended claims.

INDUSTRIAL APPLICABILITY

The sound barrier is useful in the exclusion of sound from the interior of aircraft and for enclosures of equipment producing strong tones, such as transformers.

I claim:

1. A sound barrier comprising:

a pair of spaced apart members for reflecting and propagating sound waves impinging thereon;

a medium disposed between said members for propagating sound waves, said spaced apart members producing a transmission loss in said impinging sound waves and said spaced apart members, said medium, and said impinging sound waves coacting to produce a resonant condition occurring at one or more particular frequencies to reduce said transmission loss of said impinging sound waves at and around said particular frequencies; and one or more acoustical resonators coupled to said medium and tuned to one or more of said particular frequencies to cause a transmission loss at and around said particular frequencies.

2. The barrier of claim 1 wherein said pair of spaced apart members are adapted to entrap said medium therebetween and to produce a compressional force therebetween when said sound waves impinge thereon, thereby giving rise to said resonant condition.

3. A sound barrier for producing substantial transmission loss in sound waves impinging thereon comprising:

a pair of spaced apart members for substantially reflecting said sound waves;

a fluid medium disposed between said members for propagating sound waves; and one or more acoustical resonators communicating with said fluid medium and tuned to one or more selected frequencies.

4. The barrier of claim 3 wherein said spaced apart members are aluminum or plastic.

5. The sound barrier of claim 3 wherein said spaced apart members, said medium, and said sound waves coact to produce a resonant condition to reduce said transmission loss of said sound waves at and around one or more particular frequencies.

6. The barrier of claim 3 wherein said resonators are disposed around the outer periphery of said members and communicate with said medium.

7. The barrier of claim 3 wherein said resonators are disposed between said members and communicate with said medium.

8. The barrier of claim 7 wherein said resonators are supported by a netting disposed between said members.

9. The barrier of claim 7 wherein said resonators are supported by sound absorbing means disposed between said members.

10. The barrier of claim 3 wherein said resonators are spherically shaped and each have a throat coupled to said medium.

11. The barrier of claim 10 wherein said spherical resonators are formed by mating two sheets having hemispherical depressions therein.

12. The barrier of claim 3 wherein said resonators are hemispherically shaped and each have a throat coupled to said medium.

13. The barrier of claim 3 wherein said resonators are hemispherically shaped and the flat portions of said resonators form a portion of one of said members.

14. The sound barrier of claim 5 wherein one or more of said selected frequencies are coincident with one or more of said particular frequencies.

15. The sound barrier of claim 3 wherein said members comprise panels adapted to substantially reflect said sound waves.

16. A sound barrier for producing substantial transmission loss in sound waves impinging thereon comprising:

a pair of fluid impermeable spaced apart members for producing said substantial transmission loss in said sound waves, a fluid medium disposed between said members for propagating sound waves, and one or more acoustical resonators coupled to said medium and tuned to one or more selected frequencies to cause a transmission loss at and around said selected frequencies.

17. The sound barrier of claim 16 wherein said spaced apart members are aluminum or plastic.

18. The barrier of claim 16 wherein said spaced apart members, said medium and said sound waves coact to produce a resonant condition at one or more particular frequencies and said resonators are tuned to one or more of said particular frequencies.

19. The barrier of claim 16 wherein said resonators are disposed around the outer periphery of said members and communicate with said medium.

20. The barrier of claim 16 wherein said resonators are disposed between said members and communicate with said medium.

21. The barrier of claim 20 wherein said resonators are supported by a netting disposed between said members.

22. The barrier of claim 20 wherein said resonators are supported by sound absorbing means disposed between said members.

23. The barrier of claim 16 wherein said resonators are spherically shaped and each have a throat coupled to said medium.

24. The barrier of claim 23 wherein said spherical resonators are formed by mating two sheets having hemispherical depressions therein.

25. The barrier of claim 24 wherein said resonators are hemispherically shaped and each have a throat coupled to said medium.

26. A sound barrier comprising:

a pair of fluid impermeable spaced apart members for reflecting and propagating sound waves impinging thereon;

a fluid medium disposed between said members for propagating sound waves, said spaced apart members, said fluid medium, and said impinging sound waves coacting to produce a resonant condition at one or more particular frequencies; and one or more acoustical resonators, said resonators being coupled to said fluid medium and tuned to one or more of said particular frequencies.

27. A sound barrier comprising:

a pair of spaced apart members for reflecting and propagating sound waves impinging thereon;

a medium disposed between said members capable of propagating sound waves, said spaced apart members being adapted to entrap said medium therebetween, said spaced apart members, said medium and said impinging sound waves coacting to produce a resonant condition at one or more particular frequencies; and one or more acoustical resonators coupled to said medium and tuned to one or more of said particular frequencies.

* * * * *